United States Patent [19]

Rogers et al.

[11] Patent Number: 4,537,212

[45] Date of Patent: Aug. 27, 1985

[54] METHOD AND SYSTEM FOR TANK OVERFILL PROTECTION

[75] Inventors: Colin C. Rogers; John N. Baker; Joseph Estebanez, all of Chester, England

[73] Assignee: Shell Oil Company, Houston, Tex.

[21] Appl. No.: 560,095

[22] Filed: Dec. 12, 1983

[30] Foreign Application Priority Data

Dec. 31, 1982 [GB] United Kingdom ..... 8237085

[51] Int. Cl.[3] ..... B67D 5/372

[52] U.S. Cl. ..... 137/2; 141/192

[58] Field of Search ..... 137/2, 14; 141/192, 141/197

[56] References Cited

U.S. PATENT DOCUMENTS 2,695,122 11/1954 Learman ..... 141/197 X 3,347,286 10/1967 Smith ..... 141/192 X

*Primary Examiner*—Alan Cohan

[57] ABSTRACT

A method and system for tank overfill prevention comprising the steps of supplying fluid to the interior of the tank by means of a dispenser, measuring the dispenser pressure $P_d$ and flow rate Q, determining at equal time increments $\delta t$ a number of quantities representing tank pressures, another quantity representing the rate of increase of tank pressure with respect to time, comparing the quantity thus obtained with a present critical value, and shutting off the fluid supply, if this said quantity exceeds the said preset critical value and if the said flow rate Q is less than a preset critical value.

16 Claims, 2 Drawing Figures

METHOD AND SYSTEM FOR TANK OVERFILL PROTECTION

BACKGROUND OF THE INVENTION

The invention relates to a method and system for tank overfill protection.

In certain tanks, for example automotive liquefied petroleum gas tanks, known as LPG tanks, a restriction on fill level is necessary to allow for the thermal expansion of the fluid within the tank. In some instances present practice in self-service automotive LPG stations relies on action by the customer to limit the tank fill level while refuelling. However, this action may not be carried out correctly and involves risk of overfilling the tank. Therefore, it is desirable to have an overfill prevention system to avoid the risk of overfilling a tank.

SUMMARY OF THE INVENTION

It is an object of the invention to provide a method for tank overfill prevention which can limit tank fill level without any customer action, taking into account the range of tank sizes, product compositions and temperatures encountered in service.

It is another object of the invention to provide a system for carrying out the above-mentioned method.

The present invention has been based upon the discovery that the filling process of a tank such as an LPG fuel tank, is characterized by a sharp increase in tank pressure towards the end of the fill. According to the invention this sharp increase in tank pressure is used as a fill characteristic to trigger fuel shut-off.

The invention therefore provides a method for tank overfill prevention comprising the steps of supplying fluid to the interior of the tank by means of a dispenser, measuring the dispenser pressure $P_d$ and flow rate Q. Determining at equal time increments $\delta t$ a number of quantities representing tank pressures from the said dispenser pressure and flow rate measurements, deriving from the determined quantities representing tank pressures another quantity representing the rate of increase of tank pressure with respect to time, comparing the quantity thus obtained with a preset critical value, and shutting off the fluid supply, if this said quantity exceeds the said preset critical value and if the said flow rate Q is less than a preset critical value.

The invention also provides a system for tank overfill prevention, comprising means for supplying fluid to the interior of the tank by means of a dispenser, means for measuring the dispenser pressure $P_d$ and the flow rate Q. Means are provided for determining at equal time increments $\delta t$ a number of quantities representing tank pressures from the said dispenser pressure and flow rate measurements. Means are used to derive from the determined quantities representing tank pressures, another quantity representing the rate of increase of tank pressure with respect to time and comparing this quantity with a preset critical value, and shutting off of the fluid supply, if the quantity exceeds the said preset critical value and the flow rate Q, is less than a preset critical value.

BRIEF DESCRIPTION OF THE DRAWINGS

The invention will now be described by way of example in more detail with reference to the accompanying drawings, in which.

DESCRIPTION OF A PREFERRED EMBODIMENT

Figure 1:
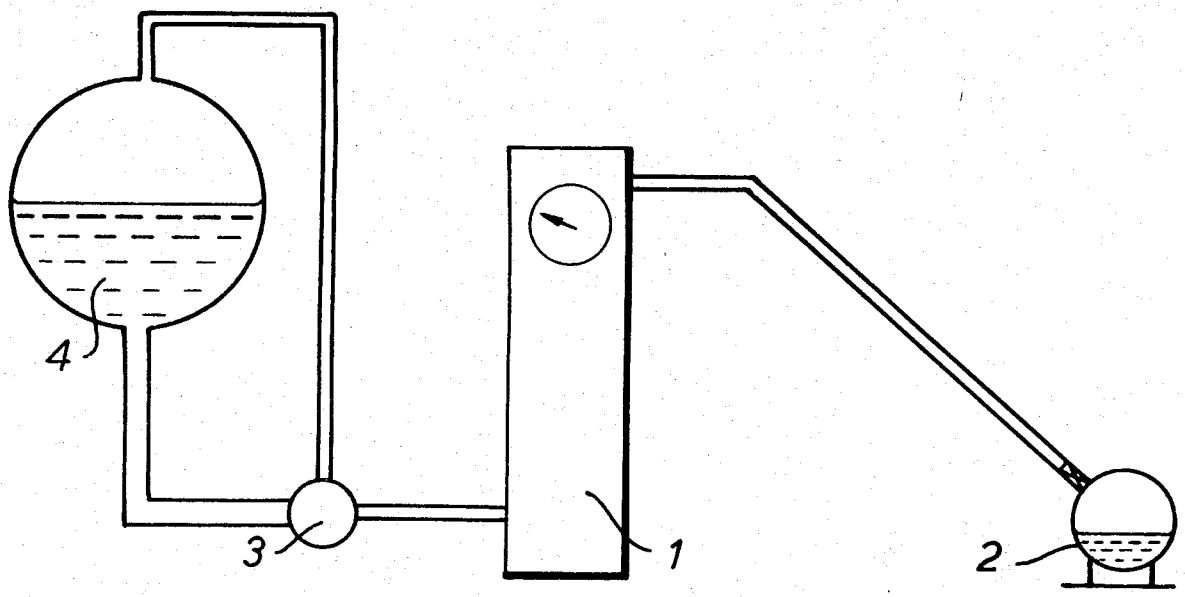
FIG. 1 represents schematically an automotive LPG dispensing facility.

With reference now to FIG. 1 a dispenser 1 has been represented schematically. During the filling process a tank 2 has been connected by any suitable hose to the dispenser 1 while a pump 3 supplies fuel from a fuel supply 4 to the tank 2 via the dispenser 1.

Figure 2:
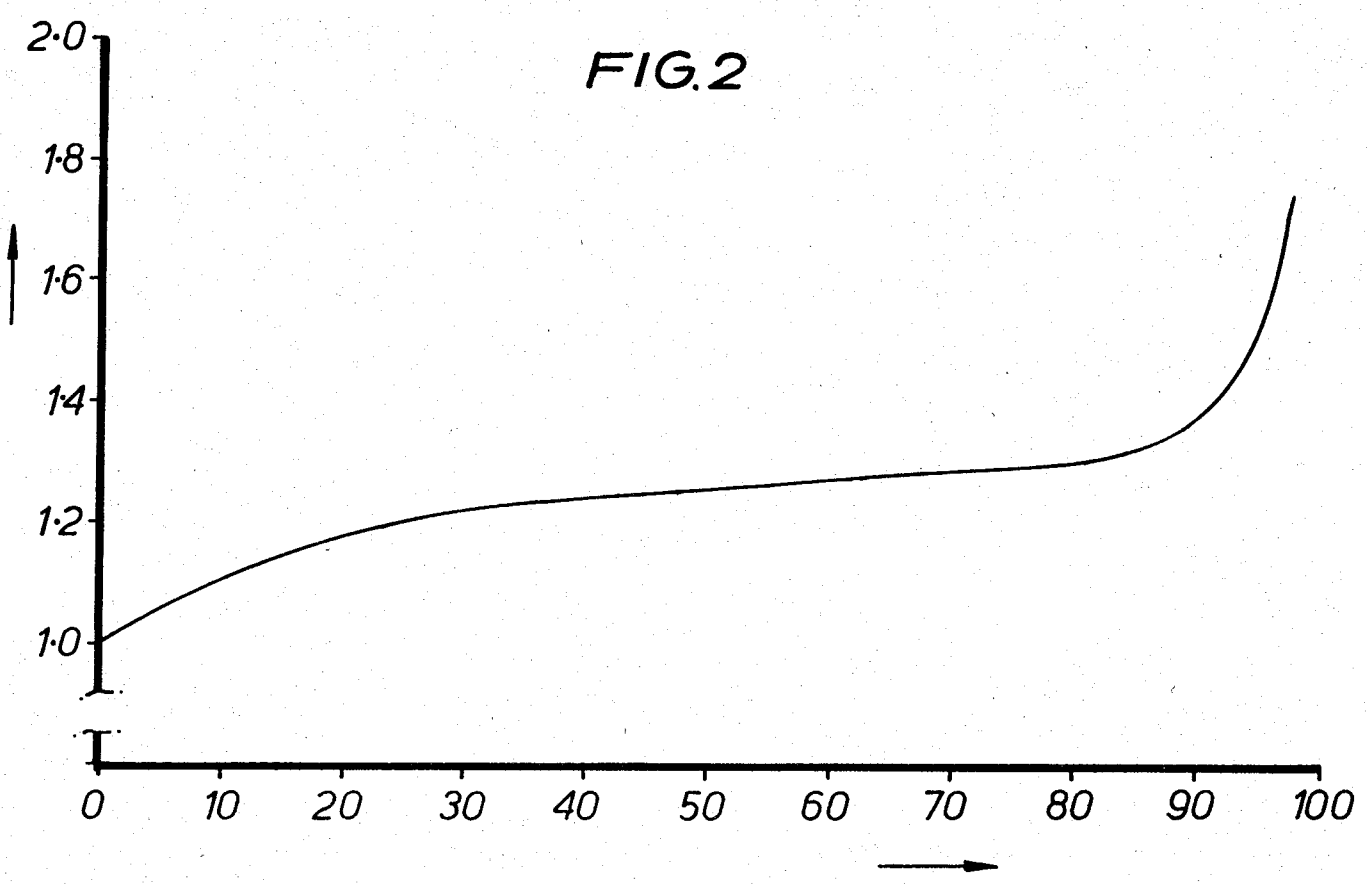
FIG. 2 represents a typical tank pressure rise characteristic.

FIG. 2 represents a typical tank pressure rise characteristic. The vertical axis represents the relation $$\frac{\text{tank pressure } P_g}{\text{initial tank pressure } P_{g0}},$$

whereas the horizontal axis represents % fill.

It appears from the figure that a sharp tank pressure increase occurs during the filling process.

According to the method of the invention the dispenser pressure $P_d$ and the flow rate Q, are measured by any suitable means (not shown for the sake of clarity). Such means are, for example, provided on the dispenser.

As already indicated earlier, the present invention is based upon the discovery that a sharp increase in tank pressure towards the end of the filling process can be used to trigger fuel shut-off.

Since there is no direct access to the customer's vehicle tank, tank pressure must be determined from the measurements made on the dispenser.

For any given tank and dispenser configuration and LPG blend the hydraulic loss between the dispenser and LPG tank is a function of flow rate alone. The tank pressure can be derived from the dispenser pressure $P_d$ and flow rate Q, using the relationship: tank pressure$=P_d-\Delta P$ wherein $\Delta P$ represents some function of flow rate.

Further, a sequence is executed to generate values of tank pressure $P_0, P_1 \ldots P_6$, at equal time increments $\delta t$. As already described in the foregoing, the tank pressure is derived from the measurements of dispenser pressure and flow rate by calculating an assumed pressure drop between the dispenser and LPG tank.

Experimental work has shown that the pressure drop/flow rate relationships can be adequately represented by 2nd degree polynomials, thus:

$$\Delta P=147.9-1.05Q+0.084Q^2$$

for tanks fitted with conventional filler valves, valid for $Q>10$ l/min and $$\Delta P=255.5-32.5Q+2.16Q^2$$

for tanks filled with the multi-valve filler assemblies, valid for $Q>7.5$ l/min.

A multi-valve tank is an alternative type of automotive LPG tank design, in which all the tank valving is contained within one multi-valve assembly.

In comparison with conventional tanks the fuel flow into multi-valve tanks is very much restricted, both by the physical size of the filler valve within the multi-valve and by the small bore filler pipe linking the multi-valve to the external fill point on the automobile.

These empirical relationships apply to automotive tanks in the so-called "external fill" configuration, i.e.

with the filler valve remote from the tank itself and linked to the tank by a length of steel piping. It is expected that these relationships will be valid for a wide range of automotive installations, although the length of the pipe run between the filler valve and automotive tank varies from vehicle to vehicle, the major portion of the hydraulic losses occur in the refuelling coupling and in the valving of the automotive installation. Since the size and design of the automotive valving is standard and the refuelling coupling is a "known" quantity, located on the retail outlet, it is apparent that the sum of the hydraulic losses between the dispenser and tank will be insensitive to the small variations in pipe run, which occur from vehicle to vehicle.

Once seven successive determinations of tank pressure $P_0$, $P_1 \ldots P_6$ have been carried out, a tank pressure versus time curve can be derived and a least squares 2nd degree polynomial can be fitted to such a curve.

Since the tank pressures are derived at equal increments in time, $\delta t$, it will be clear to those skilled in the art that the slope of the curve at the midpoint can be given by the relationship:

$$\frac{dP}{dt} = \frac{3(P_6 - P_0) + 2(P_5 - P_1) + (P_4 - P_2)}{28\,\delta t}$$

If dP/dt exceeds a preset critical value $(dP/dt)_{crit}$ and the flow rate is less than a critical value $Q_{crit}$, a relay output is actuated to trigger shut-off of the delivery pump. Otherwise, the process is repeated; the derived tank pressure values $P_0$, $P_1 \ldots P_5$ are updated, a new value for the tank pressure, $P_6$, is derived, a new comparison is carried out, etc.

A secondary shut-off mode, on flow rate, is provided at all times, this comes into effect whenever the flow rate falls below a value $Q_*$. An advantageous value is for example $Q_* = 10$ l/min for conventional tanks and $Q_* = 7.5$ l/min for multivalve tanks.

It is also necessary to stipulate a critical value of flow rate, $Q_{crit}$, above which fuel shut-off cannot occur, so as to prevent premature fuel shut-off at the start of the filling process, when the tank pressure can be rising quickly.

Advantageous critical values are $(dP/dt)_{crit} = 6.16$ kPa/s and $Q_{crit} = 30.0$ l/min for conventional tanks and $(dP/dt)_{crit} = 5.55$ kPa/s and $Q_{crit} = 15.6$ l/min for multivalve tanks.

Still another advantageous critical value $(dP/dt)_{crit}$ may be 4.93 kPa/s; this critical value can be used for conventional tanks as well as multivalve tanks.

Advantageous time increments are for example $\delta t = 0.85$ s for conventional tanks and $\delta t = 1.77$ s for multivalve tanks.

However, it will be appreciated that any critical values, time increments and pressure drop/flow rate relationships suitable for the purpose can be used.

Further, it will be appreciated that the calculations and comparisons can be carried out by means of a suitable computer.

Various modifications of the invention will become apparent to those skilled in the art from the foregoing description and accompanying drawings. Such modifications are intended to fall within the scope of the appended claims.

What is claimed is:

1. A method for preventing the overfilling of an LPG tank comprising:

supplying LPG fuel to said tank while measuring the pressure and flow rate of said LPG fuel;

determining for equal time intervals the tank pressure using the measured pressure and flow rate of said LPG fuel;

determining from said tank pressures the rate of increase of the tank pressure with respect to time;

comparing said determined rate of increase of tank pressure with a preselected rate of increase of tank pressure; and shutting off the LPG fuel if said determined rate exceeds said preselected rate and said flow rate is less than a preselected flow rate.

2. The method as claimed in claim 1, wherein a sequence of 7 values representing tank pressures is generated.

3. The method as claimed in claim 1, wherein said preselected rate of increase of tank pressure with respect to time is 6.16 kPa/s.

4. The method as claimed in claim 1, wherein said preselected rate of increase of tank pressure with respect to time is 5.55 kPa/s.

5. The method as claimed in claim 1, wherein said preselected rate of increase of tank pressure with respect to time is 4.93 kPa/s.

6. The method as claimed in claim 1, wherein the time intervals are each 0.85 seconds.

7. The method as claimed in claim 1, wherein the time intervals are each 1.77 seconds.

8. The method as claimed in claim 1, wherein said preselected flow rate is 30.0 l/min.

9. The method as claimed in claim 1, wherein said preselected flow rate is 15.6 l/min.

10. The method as claimed in claim 2, wherein said preselected rate of increase of tank pressure with respect to time is 6.16 kPa/s.

11. The method as claimed in claim 2, wherein said preselected rate of increase of tank pressure with respect to time is 5.55 kPa/s.

12. The method as claimed in claim 2, wherein said preselected rate of increase of tank pressure with respect to time is 4.93 kPa/s.

13. The method as claimed in claim 2, wherein the time intervals are each 0.85 seconds.

14. The method as claimed in claim 2, wherein the time intervals are each 1.77 seconds.

15. The method as claimed in claim 2, wherein said preselected flow rate is 30.0 l/min.

16. The method as claimed in claim 2, wherein said preselected flow rate is 15.6 l/min.

* * * * *